US010760215B2

(12) United States Patent
Akahori et al.

(10) Patent No.: US 10,760,215 B2
(45) Date of Patent: Sep. 1, 2020

(54) GLASS PLATE-INTERLEAVING PAPER

(71) Applicant: Tokushu Tokai Paper Co., Ltd., Shizuoka (JP)

(72) Inventors: Shinichi Akahori, Gifu (JP); Tomoki Hirasawa, Sunto-gun (JP); Yoshiaki Tomotake, Sunto-gun (JP); Yasuhiko Asai, Sunto-gun (JP); Takayuki Nishimura, Sunto-gun (JP)

(73) Assignee: TOKUSHU TOKAI PAPER CO., LTD., Shizuoka (JP)

( * ) Notice: Subject to any disclaimer, the term of this patent is extended or adjusted under 35 U.S.C. 154(b) by 0 days.

(21) Appl. No.: 15/124,859

(22) PCT Filed: Mar. 13, 2015

(86) PCT No.: PCT/JP2015/057491
§ 371 (c)(1),
(2) Date: Sep. 9, 2016

(87) PCT Pub. No.: WO2015/137488
PCT Pub. Date: Sep. 17, 2015

(65) Prior Publication Data

US 2017/0073897 A1 Mar. 16, 2017

(30) Foreign Application Priority Data

Mar. 13, 2014 (JP) ..... 2014-050853

(51) Int. Cl.

| | |
|---|---|
| ***D21H 27/00*** | (2006.01) |
| ***D21H 17/63*** | (2006.01) |
| ***D21H 17/68*** | (2006.01) |
| ***D21H 17/67*** | (2006.01) |
| ***D21H 17/37*** | (2006.01) |

(52) U.S. Cl.
CPC ..... *D21H 17/675* (2013.01); *D21H 17/375* (2013.01); *D21H 17/63* (2013.01); *D21H 17/67* (2013.01); *D21H 17/68* (2013.01); *D21H 27/00* (2013.01)

(58) Field of Classification Search
CPC ..... D21H 17/13; D21H 27/10; D21H 27/32; B65G 57/005; C03B 40/033; Y02P 40/57
See application file for complete search history.

(56) References Cited

U.S. PATENT DOCUMENTS

| | | | | |
|---|---|---|---|---|
| 4,807,743 | A * | 2/1989 | Yasuda | B65D 81/26 206/204 |
| 5,593,544 | A * | 1/1997 | Fahlgren | D21C 1/04 162/19 |
| 6,024,619 | A | 2/2000 | Mori et al. | |
| 6,428,705 | B1 * | 8/2002 | Allen | B01D 61/16 210/638 |
| 2005/0034823 | A1 * | 2/2005 | Brelid | D21C 1/04 162/37 |
| 2009/0308774 | A1 * | 12/2009 | Kim | B65D 57/00 206/454 |
| 2013/0273612 | A1 * | 10/2013 | Medoff | C10G 3/00 435/99 |

FOREIGN PATENT DOCUMENTS

| | | | |
|---|---|---|---|
| CN | 1236411 | A | 11/1999 |
| CN | 101437772 | A | 5/2009 |
| CN | 102114938 | A | 7/2011 |
| CN | 102418298 | A | 4/2012 |
| CN | 103541278 | A | 1/2014 |
| JP | H11-133889 | A | 5/1999 |
| JP | 11-165742 | A | 6/1999 |
| JP | 2001-113464 | A | 4/2001 |
| JP | 2005-256218 | A | 9/2005 |
| JP | 2006-044674 | A | 2/2006 |
| JP | 2006044674 | A * | 2/2006 |
| JP | 2006-144133 | A | 6/2006 |
| JP | 2007-131965 | A | 5/2007 |
| JP | 2008-080500 | A | 4/2008 |
| JP | 2008-143542 | A | 6/2008 |
| JP | 2008143542 | A * | 6/2008 |
| JP | 2008-208478 | A | 9/2008 |
| JP | 2008-297661 | A | 12/2008 |
| JP | 2009-179379 | A | 8/2009 |
| JP | 2009-184704 | A | 8/2009 |

(Continued)

OTHER PUBLICATIONS

Translation; JP-2008143542-A; Jun. 2008; Hirata, Chiyomaro.*
Translation; JP-20013212939-A; Oct. 2013;Isaki, Yashuhiro.*
Mohs Hardness Test; http://www.oakton.edu/user/4/billtong/eas100lab/hardness.htm; William K Tong copyright 2000 (Year: 2000).*
JP-2006044674-A—Bib data and translation; Tahira, Hisami; Feb. 2006 (Year: 2006).*
JP-2014095163-A Bib Data and Translation; Yamamoto Hiroki (Year: 2014).*
International Search Report corresponding to International Patent Application No. PCT/JP2015/057491, dated Jun. 2, 2015.

(Continued)

*Primary Examiner* — Humera N. Sheikh
*Assistant Examiner* — Elizabeth D Ivey
(74) *Attorney, Agent, or Firm* — Lathrop GMP LLP; Brian C. Trinque

(57) ABSTRACT

The present invention relates to glass plate-interleaving paper, which is used for a glass plate for use in a display, and in which wood pulp is used as a raw material, and the number of foreign substances having a Mohs hardness of 4 or higher present on the surface of the glass plate-interleaving paper is fewer than 0.010 per square meter. Even if the glass plate-interleaving paper of the present invention is used in a conventional way as glass plate-interleaving paper with respect to a glass plate used as a substrate material for a flat panel display in which high cleanliness and high quality are required, the glass plate-interleaving paper is able to prevent damage or cracks occurring on the surface of the glass plate.

11 Claims, No Drawings

(56) References Cited

FOREIGN PATENT DOCUMENTS

| | | | | |
|---|---|---|---|---|
| JP | 2009-274260 | A | | 11/2009 |
| JP | 2010-242057 | A | | 10/2010 |
| JP | 2012-188785 | A | | 10/2012 |
| JP | 2013-014348 | A | | 1/2013 |
| JP | 2013-212939 | A | | 10/2013 |
| JP | 2013212939 | A | * | 10/2013 |
| JP | 2014095163 | A | * | 5/2014 |
| WO | 2011/136108 | A1 | | 11/2011 |

OTHER PUBLICATIONS

Office Action corresponding to Japanese Patent Application No. 2016-507848, dated Nov. 1, 2016—with English translation.
Office Action corresponding to Chinese Patent Application No. 201580013236.1, dated Jul. 31, 2017—with English translation.
Office Action corresponding to Chinese Patent Application No. 201580013236.1, dated Jul. 1, 2017—with English translation.
Notice of Allowance in related Chinese Application No. 201580013236.1, dated Mar. 24, 2020 (5 pages).

* cited by examiner

GLASS PLATE-INTERLEAVING PAPER

RELATED APPLICATIONS

This application is a 35 U.S.C. § 371 filing of International Application No. PCT/JP2015/057491, filed Mar. 13, 2015, which claims priority to Japanese Patent Application No. 2014-050853, filed Mar. 13, 2014, each of which is incorporated herein by reference in their entireties.

TECHNICAL FIELD

The present invention relates to paper for packaging glass plates and paper to be inserted between glass plates (interleaving paper), used in the process of transporting and storing glass plates. In particular, the present invention relates to paper suitably usable as interleaving paper for glass plates for use in flat panel displays such as liquid crystal panel displays, plasma displays, and organic electroluminescence (organic EL) displays.

BACKGROUND ART

In general, during the course of storage of glass plates in a laminated state, or during the course of distribution of transporting them by trucks and the like, damage or cracks on the surface of glass plates may occur by mutually contacting glass plates on impact.

In particular, glass plates for flat panel displays are used for high-definition displays, which are different from common architectural glass plates, vehicular glass plates, and the like. For this reason, the surface of glass plates for flat panel displays requires maintaining a clean surface so that damage or cracks do not exist, and requires having a superior flatness for a fast-response property or wide viewing angle. For example, even if damage or cracks on the surface of glass plates are minute, there may be problems in that electronic elements or devices cannot be formed or interconnection may be disconnected at the damaged or cracked parts. For this reason, there is a process for inserting interleaving paper between glass plates (glass plate-interleaving paper) for the purpose of preventing damage or cracks on the surface of glass plates.

Some types of glass plate-interleaving paper for such a usage, for example, glass plate-interleaving paper by which cracking or surface damage of glass plates can be prevented, and interleaving paper by which the surface of glass plates is not contaminated, have been proposed. For example, Patent Document 1 discloses a method of forming a fluorine coating film on the surface of glass plate-interleaving paper. In addition, Patent Document 2 discloses glass plate-interleaving paper to which a foamed sheet made of a polyethylene-based resin and a film made of a polyethylene-based resin are applied. Patent Document 3 discloses glass plate-interleaving paper, which is formed from pulp containing 50% by mass or more of bleached chemical pulp, and includes a specific alkylene oxide adduct and a water-soluble polyether-modified silicone. In addition, Patent Document 4 discloses glass plate-interleaving paper in which a resin content in the paper is specified, and a raw material selected in view of contamination of the surface of glass plates is used.

PRIOR ART DOCUMENTS

Patent Documents

Patent Document 1: Japanese Unexamined Patent Application, First Publication No. 2012-188785

Patent Document 2: Japanese Unexamined Patent Application, First Publication No. 2010-242057

Patent Document 3: Japanese Unexamined Patent Application, First Publication No. 2008-208478

Patent Document 4: Japanese Unexamined Patent Application, First Publication No. 2006-44674

DISCLOSURE OF INVENTION

Technical Problems

However, even if glass plate-interleaving paper is used for the purpose of preventing damage and cracks of glass plates, the prevention thereof could not be completely carried out. In some cases, a failure rate of glass plates may be actually increased due to damage and cracks of the surface of glass plates for some unknown reasons.

In particular, if even minute damage or cracks exist on the surface of glass plates for flat panel displays, possibilities of disconnection or short circuits occurring may be increased.

For this reason, glass plate-interleaving paper which causes reduced damage or cracks on the surface of glass plates, as compared with conventional glass plate-interleaving paper, is required. In addition, the surface of a glass plate is used as an image display surface. For this reason, cleanliness and beauty of the glass plates are also required. From a viewpoint of this as well, reduction in damage, cracks, or the like is required. In addition, in the case of increasing a defective rate due to damage or cracks, a problem in view of profitability arises. Therefore, how to prevent damage or cracks on the surface of glass plates for use in flat panel displays and how to realize an increased yield are important issues.

The present invention has an object to remarkably prevent cracking or damage on the surface of glass plates for use as substrate materials for flat panel displays in which high quality is required.

Technical Solution

For example, if the surface of a glass plate has cracks or damage, at the time of manufacturing a color filter substrate in an array process which is one of processes of manufacturing TFT liquid crystal displays, a problem such as disconnection may occur. A color filter substrate is manufactured by forming a thin film such as a semiconductor film, an ITO film (transparent conductive film), an insulating film, an aluminum metal film or the like on a glass plate by means of a sputtering method, a vacuum deposition method or the like. If cracks or damage exist on the surface of a glass plate, disconnection may occur in a circuit pattern formed from a thin film or short circuits caused by defects of an insulating film may occur. In addition, during manufacture of a color filter substrate, a pattern is formed on a glass plate by means of photolithography. If cracks or damage exist on the surface of the glass plate at the time of resist application in the aforementioned process, a pinhole is formed on the resist film after exposure or development, and as a result, disconnection or short circuit may occur. It was difficult to specify a causality of such cracks or damage of glass plates. However, it was first revealed in diligent work carried out by the inventors of the present application that there is a relationship between a Mohs hardness of foreign substances present on the surface of glass plate-interleaving paper and cracks or damage occurring on the surface of glass plates. In addition, it was discovered that even if the foreign substances were minute, they damaged the surface of glass plates so that scratches formed at the time of glass plates or interleaving paper being moved resulted in minute damage which remained as scars for a long period of time.

The present invention relates to glass plate-interleaving paper, of which a raw material is wood pulp, wherein the number of foreign substances having a Mohs hardness of 4 or higher present on the surface of the glass plate-interleaving paper is fewer than 0.010 per square meter.

The foreign substances mentioned above preferably comprise metal oxide or silicon oxide. The silicon oxide mentioned above is preferably silicon dioxide.

The foreign substances mentioned above are more preferably one or more substances selected from the group consisting of iron oxide, copper, quartz, fused quartz, titanium oxide, glass pieces, crystal pieces, magnesium oxide, and sand.

The foreign substances mentioned above preferably have a volume of less than $2\times10^{-5}$ $mm^3$.

The glass plate-interleaving paper of the present invention preferably has a basis weight ranging from 20 to 100 $g/m^2$.

The glass plate-interleaving paper of the present invention preferably has a thickness ranging from 0.030 to 0.130 mm.

The glass plate-interleaving paper of the present invention preferably has a moisture content ranging from 2 to 10% by mass. The glass plate mentioned above is preferably for use in a display.

The display is preferably a TFT liquid crystal display or an organic EL display.

The present invention also relates to a laminate comprising glass plates and the glass plate-interleaving paper mentioned above.

Effects of the Invention

When the glass plate-interleaving paper of the present invention is used for glass plates, occurrences of damage on the surface of glass plates can be prevented even if the glass plate-interleaving paper contacts with the surface of the glass plates. For this reason, in particular, a production yield of glass plates for flat panel displays can be improved. In addition, the glass plate-interleaving paper of the present invention can greatly inhibit occurrences of damage or cracks of glass plates. Thereby, circuit disconnection of a color film or the like in a process of manufacturing a TFT liquid crystal display and the like can be prevented.

MODES FOR CARRYING OUT THE INVENTION

In the glass plate-interleaving paper of the present invention, wood pulp is used as a raw material, and the number of foreign substances having a Mohs hardness of 4 or higher present on the surface of the glass plate-interleaving paper is fewer than 0.010 per square meter. When glass plate-interleaving paper is used for glass plates, foreign substances on the surface of the interleaving paper contact the glass plates and tend to damage to the glass plates. In particular, it has been clarified at present that if glass plate-interleaving paper in which the number of foreign substances present on the surface of the glass plate-interleaving paper is 0.010 or more per square meter is used, minute damage or cracks occurring on the surface of the glass plates are greatly increased, and as a result, this causes a problem at the time of forming a panel. The "fewer than 0.010 per square meter" means that, for example, when foreign substances present on 500 $m^2$ of the surface of glass plate-interleaving paper are checked, a numerical value obtained by converting the number of the foreign substances into the number per unit area (1 $m^2$) by calculation is fewer than 0.010.

The sentence "the number of foreign substances having a Mohs hardness of 4 or higher present on the surface of the glass plate-interleaving paper is fewer than 0.010 per square meter" in the present invention means that under the state in which the glass plate-interleaving paper of the present invention exists alone, that is, under the state in which the glass plate-interleaving paper of the present invention is not laminated with glass plates, an existence ratio of the foreign substances present on the surface of the glass plate-interleaving paper is fewer than 0.010 per square meter. It is preferable that under the state in which the glass plate-interleaving paper of the present invention contacts glass plates or is pressed by the glass plates, that is, under the state in which the glass plate-interleaving paper of the present invention is laminated with glass plates, an existence ratio of the foreign substances present on the surface of the aforementioned interleaving paper be fewer than 0.010 per square meter.

In order to obtain the glass plate-interleaving paper in which the number of foreign substances having a Mohs hardness of 4 or higher present on the surface of the glass plate-interleaving paper is fewer than 0.010 per square meter, it is important that pulp as a raw material, and other raw materials for papermaking such as chemicals for use in papermaking, loading materials and the like are selected and controlled, and a series of processes containing all steps of from a preparation step of raw materials to a finalizing step during papermaking is controlled. In particular, it is important that wood pulp as a raw material of the glass plate-interleaving paper does not include a large amount of foreign substances. By using wood pulp with a reduced amount of foreign substances as a raw material, the glass plate-interleaving paper of the present invention can be produced.

In general, various types of foreign substances are included in wood pulp. For example, foreign substances derived from wood which is a raw material of wood pulp, foreign substances derived from cooking chemicals during preparation of pulp, foreign substances derived from chemicals used during an unbleached washing step, metal foreign substances derived from waste paper raw materials, or foreign substances derived from water used during the steps of making pulp may be mentioned as causes of foreign substances. For this reason, in the present invention, washing and screening of pulp which is a raw material of glass plate-interleaving paper are important, and removal of foreign substances to a high level is required.

In general, during steps of producing pulp, pulp obtained by subjecting wood chips to cooking is subjected to a delignification treatment, and subsequently, the pulp is washed, followed by bleaching. First, at the wood chip stage, it is preferable that wood chips are subjected to removal of foreign substances and washing. For example, foreign substances such as metal, sand and the like are preferably removed by means of a known system for removing foreign substances such as a chip washer or the like. In addition, during the steps of producing pulp, the purpose of washing after cooking is to remove cooking chemicals, lignin decomposition products, and colored components remaining in a pulp mixture, and at the same time, foreign substances can also be removed. For example, a known method such as a washing system in countercurrent using various types of washing devices such as a vacuum-type filter washing device, a pressure drum-type filter washing device, a press-type washing device, and a diffuser washing device, can be applied. In particular, in order to remove foreign substances and improve cleanliness, an amount of washing water used is preferably increased, or a multi-stage system having two or more washing-and-rinsing stages is preferably applied. In the chemicals such as a surfactant, a pH adjustor, a pitch controller, a chelating agent, a defoaming agent and the like, prevention of use of substances causing foreign substances is more preferable. For example, an inorganic oil-based defoaming agent used as a defoaming agent can be a cause of inorganic foreign substances of glass plate-interleaving paper. For this reason, the usage amount of the inorganic oil-based defoaming agent is preferably suppressed, or such an inorganic oil-based defoaming agent is preferably replaced with another deforming agent.

After the washing step mentioned above, a bleaching step is carried out. Even in the bleaching step, it is preferable to remove foreign substances as much as possible. For example, a washing device may be set at each of the bleaching stages. Here, a known washing device can be used, and for example, a pressure diffuser, a diffusion washer, a pressure-type drum washer, a horizontal long net-type washer, a press washing device, or the like can be used. Chemicals such as an alkali, an acid, a chelating agent, a surfactant, a defoaming agent and the like may also be added to the washing water. However, it is preferable to inhibit the use of substances causing foreign substances. In addition, measures to prevent contamination of foreign substances are preferably carried out between steps. In addition, a method for removing iron components or ingredients described below is more preferably combined.

In the case of using waste pulp as a raw material in the present invention, foreign substances such as metal and the like are preferably removed at high level by means of a pulper, a screen, a cleaner, or the like.

Next, as a possible cause of mixing foreign substances into glass plate-interleaving paper, contamination may occur during papermaking steps. For example, there may be the case in which foreign substances are mixed into chemicals for papermaking, the case in which elements or materials of devices fall and foreign substances are mixed into paper, or the like. In a method for removing foreign substances during such papermaking steps, a dust-removing device such as a cleaner, a screen device, or the like, or another cleaning device may be used. In the present invention, a known device can be used in the removal methods mentioned above. For example, a centrifugal cleaner, a particularly-heavy-impurity cleaner, a medium-consistency cleaner, a light-impurity cleaner, a whole screen separator, a slit screen separator, a vibrating screen separator of YS model, a flat screen separator, other cleaners or the like can be used. In addition, foreign substances from pipes for paper material or white water may be mixed, and for this reason, pipes and the like should be kept clean.

With respect to an iron component or ingredient which is one of causes of foreign substances, iron powder or iron rust can be mixed due to abrasion or corrosion of pipes of a papermaking device or a device of making pulp, and then be oxidized to form an iron oxide having a high Mohs hardness. For this reason, it is preferable that iron components or ingredients be selectively removed. For example, it is preferable that each piece of equipment made of a material other than iron be used, an iron component or ingredient be selectively removed by setting a ferromagnetic substance such as magnet or the like in the system, or an absorbing material which selectively adsorbs iron be arranged at the exit side of each equipment mentioned above. A selectively removing method by means of setting a ferromagnetic substance can remove not only iron, but also other magnetic materials.

Wood pulp usable in the present invention is wood pulp such as needle bleached kraft pulp (NBKP), laubholz bleached kraft pulp (LBKP), needle bleached sulfite pulp (NBSP), laubholz bleached sulfite pulp (LBSP), thermomechanical pulp (TMP) or the like, alone or in combination thereof. Wood as a raw material is preferably selected in view of production areas and wood species so that a large amount of foreign substances is not included. Non-wood pulp formed from hemp, bamboo, straw, kenaf, paper mulberry, paper birch, cotton or the like, modified pulp such as cationated pulp, mercerized pulp or the like, synthetic fiber or chemical fiber such as rayon, vinylon, nylon, acryl, polyester or the like, or microfibrillated pulp can be blended alone or in combination thereof into the aforementioned wood pulp as a main component. However, if a large amount of a resin component is contained in pulp, the resin component mentioned above may exhibit an adverse effect such as contamination of the surface of glass plates or the like. For this reason, chemical pulp with a reduced amount of a resin component as possible, such as needle bleached kraft pulp, is preferably used alone. In addition, high yield pulp such as ground wood pulp contains a large amount of a resin component, and therefore, this is not preferable. When synthetic fiber or chemical fiber is mixed together therewith, a cutting property is improved and an operation property during forming interleaving paper into a flat plate form is improved. However, it should be noted that the recycling property in view of treatment of waste is impaired in this case.

In addition, an adhesive, an antifungal agent, various loading materials for making paper, a wet paper strength agent, a dry paper strength agent, a sizing agent, a coloring agent, a fixing agent, a yield improver, slime controller, and the like may be added to fiber for making paper which contains the aforementioned wood pulp as a main component, within a scope which does not impair the performance of the present invention, if necessary. The fiber for making paper and the like can be subjected to making paper by means of a conventionally known Fourdrinier paper machine, cylinder paper machine, tanmo machine, combination machine between Fourdrinier paper machine and cylinder paper machine, or the like. Thereby, glass plate-interleaving paper of the present invention can be obtained. In the present invention, it requires scrupulous care to prevent damage or cracks of glass caused by foreign substances. For this reason, the chemicals or loading materials mentioned above are not preferably added, as possible. For example, a loading material for making paper such as titanium oxide has a high Mohs hardness, and is not suitable.

If beating of pulp is carried out, when the wood pulp of the present invention is manufactured, an effect of increasing strength between paper layers can be expected. However, if due to carrying out beating of pulp, microfiber in the wood pulp increases, paper powder may be generated during use as interleaving paper. For this reason, increasing the beating degree to a more than necessary degree is not preferable. Therefore, a preferable beating degree in the present invention ranges from 300 to 650 ml c.s.f.

In the present invention, it may be preferable that the number of foreign substances having a Mohs hardness of 4 or higher present on the surface of glass plate-interleaving paper be preferably fewer than 0.005 per square meter, more preferably fewer than 0.003 per square meter, and even more preferably fewer than 0.001 per square meter. If the number of foreign substances having a Mohs hardness of 4 or higher present on the surface of glass plate-interleaving paper is 0.005 or more per square meter, in the case of needing a very high-definition display for a mobile terminal and the like, the parts with circuit disconnection of a color film caused by damage or cracks occurring on the surface of glass may be highly visible because of high definition, and therefore, the display may be judged to be poor in quality.

During and/or after manufacture of glass plate-interleaving paper of the present invention, a processing treatment such as a calender treatment, a super calender treatment, a softnip calender treatment, an emboss treatment or the like may be carried out. By carrying out the processing treatment, a surface property or the thickness can be adjusted.

The foreign substances having a Mohs hardness of 4 or higher in the present invention may be particles comprising any of inorganic and organic substances, and are preferably inorganic particles. Examples of the foreign substances mentioned above include metal oxide or inorganic silicon oxide having a Mohs hardness of 4 or higher. The metal forming the metal oxide is not particularly limited as long as the metal oxide has a Mohs hardness of 4 or higher. Examples of such a metal include a Group 2 element such as magnesium or the like, a Group 4 element such as titanium or the like, and a Group 8 element such as iron or the like. As the inorganic silicon oxide, silicon dioxide is preferable. Examples of the foreign substances having a Mohs hardness of 4 or higher mentioned above include oxidized minerals. Examples of the foreign substances having a Mohs hardness of 4 or higher mentioned above include, in particular, an iron oxide, copper, quartz, fused quartz (quartz glass), titanium oxide, glass pieces, crystal pieces, magnesium oxide, sand, and the like. Sand is mainly formed from amphibolite having a Mohs hardness of 5.5, feldspar having a Mohs hardness of 6, and quartz having a Mohs hardness of 7. Therefore, a Mohs hardness of sand is 4 or higher, and is typically 7. A Mohs hardness indicates an index for a hardness on 10 grades and is a value obtained by relative evaluation of a degree of hardness with respect to a standard substance based on whether or not a substance to be measured is scratched by scratching the substance to be measured with the standard substance specified in each grade. The standard substances are, in order of hardness of from soft (Mohs hardness=1) to hard (Mohs hardness=10), 1: talc, 2: gypsum, 3: calcite, 4: fluorite, 5: apatite, 6: orthoclase, 7: quartz, 8: topaz, 9: corundum, and 10: diamond. A method for measuring a Mohs hardness includes preparing two plates having a smooth surface and having a known Mohs hardness, interleaving a foreign substance to be measured between the two plates mentioned above, subjecting the two plates with the foreign substance to abrasion, and checking the presence or absence of scratches on the surface of the plates.

The substances, which are easily contained in glass plate-interleaving paper as foreign substances and may scratch the surface of the glass plates, may be derived from the raw materials in many cases. In particular, they may be quartz, fused quartz, sand and crystal pieces having a Mohs hardness of 7, magnesium oxide, titanium oxide, and iron oxide having a Mohs hardness of 6, copper having a Mohs hardness ranging from 5 to 8, and glass pieces having a Mohs hardness ranging from 4 to 7, in many cases.

In the present invention, a volume of a foreign substance is preferably controlled to less than 0.00002 $mm^3$, and more preferably controlled to less than 0.00001 $mm^3$. The foreign substances are present on the surface or in the inner part of interleaving paper as a three-dimensional object, which is different from stains and the like, and cause problems. In particular, in the case of the size of the foreign substance being 0.00002 $mm^3$ or more, when the glass plate-interleaving paper including the same is used, the foreign substance contacts the surface of glass plates and possibility of generating damage or cracks tends to increase. For example, when glass plate-interleaving paper and glass plates are laminated, the foreign substances present on the surface of the glass plate-interleaving paper may be pressed due to the weight of the glass plates. If the size of the foreign substance is small, the foreign substance lies buried in the interleaving paper even if pressure is exerted. For this reason, a possibility of damaging the surface of the glass plates may be reduced. The foreign substances are a three-dimensional object as described above, and for this reason, in the case of the foreign substances having a large height even if a projected area thereof is small, visible damage may remain as scratches occurring at the time of glass or glass plate-interleaving paper being moved. On the other hand, in the case of the foreign substances having an increased projected area even if the height of the foreign substances is small, the surface of the glass plates may be scratched. Therefore, they are not preferable.

The foreign substances mentioned above have an average particle size of an equivalent diameter of equal volume sphere, which is preferably 30 μm or less, more preferably 20 μm or less, more preferably 10 μm or less, even more preferably 5 μm or less, and most preferably 1 μm or less. The equivalent diameter of equal volume sphere means, in the case of the particles of the foreign substances being converted into spheres having the same volume as that of the particle of the foreign substances, a diameter of the sphere mentioned above, and can be measured by means of a laser diffraction method, or the like.

The glass plate-interleaving paper of the present invention is used by being inserted between glass plates or by packaging a glass plate or glass plates. For example, the glass plate-interleaving paper of the present invention is typically inserted between two glass plates, and a plurality of glass plates with the glass plate-interleaving paper(s) inserted to form a laminate as a whole. The laminate mentioned above is to be stored and transported.

The glass plates are not particularly limited, but are preferably glass plates for flat panel displays such as plasma display panels, liquid crystal display panels (in particular, TFT liquid crystal display panels), organic EL display panels and the like. Micro-electrodes, micro-shielding walls and the like are formed on the surface of the glass plates for flat panel displays. By using glass plate-interleaving paper of the present invention, damage or cracks on the surface of the glass plates can be controlled and inhibited. For this reason, even if micro-electrodes, micro-shielding walls and the like are formed on the surface of the glass plates, problems caused by damage or cracks can be controlled and inhibited. As a result, defects of displays can be controlled and inhibited.

In particular, in accordance with growing in size of displays, the size and weight of the glass plates for flat panel displays are increasing. The glass plate-interleaving paper of the present invention can well protect the surface of such glass plates with a large size and a large weight. In particular, the glass plate-interleaving paper of the present invention has an greatly reduced amount of foreign substance with a high hardness. For this reason, even if pressure is exerted on glass plate-interleaving paper by glass plates with a large weight, damage on the surface of the glass plates due to foreign substances can be controlled and inhibited. Therefore, glass plate-interleaving paper of the present invention can be suitably used for glass plates for flat panel displays in which quality and cleanliness of the surface are particularly required.

The glass plate-interleaving paper of the present invention provided with the aforementioned constitution is very suitable particularly for glass plates for flat panel display substrates.

In the glass plates for flat panel display substrates, a certain film such as an alignment film or the like is formed on the surface on the glass plate, and for this reason, prevention of damage is largely required. In addition, at the same time, the surface of a glass plate is used as an image display surface, and for this reason, cleanliness and beauty are also required. In addition, glass plates may be exported to foreign markets, and for this reason, durability for the long-term transportation and the long-term storage is also required. In view of this, in the case of using the glass plate-interleaving paper of the present invention, even if the interleaving paper and a glass plate contact for a long period of time, damage are not observed on the surface of the glass plate, and blocking with the glass plate does not occur. For this reason, the glass plate-interleaving paper of the present invention can properly meet each of the requirements described above.

The glass plate-interleaving paper of the present invention has a basis weight preferably ranging from 20 to 100 g/m$^2$, more preferably ranging from 30 to 90 g/m$^2$, and further preferably ranging from 40 to 80 g/m$^2$. If the basis weight is below 20 g/m$^2$, it may be difficult to maintain the minimal air impermeability (5 or more seconds), and when only interleaving paper is to be removed by suction after the interleaving paper is used for glass plates, the glass plates themselves may also be sucked. In addition, if the basis weight is below 20 g/m$^2$, tensility of interleaving paper itself may be reduced, and a handling property may also be degraded. Therefore, it is not preferable. On the other hand, if the basis weight exceeds 100 g/m$^2$, flexibility as glass plate-interleaving paper may be impaired, and a handling property may also be degraded. In addition, glass plate-interleaving paper is used for the purposes of protection of glass plates during transportation and storage, and prevention of damage and contamination. For this reason, unduly increasing of a basis weight may cause disadvantages in view of cost, and operatability may also be reduced.

The thickness of the glass plate-interleaving paper of the present invention preferably ranges from 0.030 to 0.130 mm, more preferably ranges from 0.040 to 0.120 mm, and even more preferably ranges from 0.050 to 0.110 mm. If the thickness is below 0.030 mm, an effect of protection during transportation and storage of glass plates for which the interleaving paper is used may be reduced. Therefore, this is not preferable. In particular, it may be difficult to sufficiently exhibit a buffer function as interleaving paper. In addition, if the thickness of interleaving paper is greatly reduced, the interleaving paper may become fragile. On the other hand, if the thickness exceeds 0.130 mm, a thickness of a laminate of glass plates and glass plate-interleaving paper may be increased, and for this reason, problems in view of storage space, transportation and the like may occur.

The moisture content of the glass plate-interleaving paper of the present invention preferably ranges from 2 to 10% by mass, more preferably ranges from 3 to 9% by mass, and even more preferably ranges from 4 to 8% by mass. If the moisture content is below 2% by mass, glass plate-interleaving paper itself may become easily charged by static electricity, and a blocking phenomenon due to static electricity between glass plates and interleaving paper may occur. Therefore, this is not preferable. On the other hand, if the moisture content exceeds 10% by mass, a blocking phenomenon between glass plates and interleaving paper due to excess moisture content may occur, and dimensional stability may be impaired due to reduction of the moisture content during use.

A surface electric resistance value (conformance with JIS K 6911, 1995) of glass plate-interleaving paper of the present invention preferably ranges from $1\times10^8$ to $1\times10^{13}\Omega$, more preferably ranges from $5\times10^8$ to $5\times10^{12}\Omega$, and even more preferably ranges from $1\times10^9$ to $1\times10^{12}\Omega$. If the surface electric resistance value is below $1\times10^8\Omega$, an adhesion between a glass plate and interleaving paper may be reduced, and for this reason, a handling property may be impaired. In addition, the surface electric resistance value being below $1\times10^8\Omega$ means that moisture or a conductive substance (such as a surfactant) has been unnecessarily added. Excess moisture may adversely effect on dimensional stability of glass plate-interleaving paper. In addition, many conductive substances are organic substances, and for this reason, the substances may migrate on the surface of a glass plate contacting interleaving paper, and problems such as contamination may be caused. On the other hand, if the surface electric resistance value is high and exceeds $1\times10^{13}\Omega$, interleaving paper may easily be charged by static electricity to adhere to the surface of a glass plate contacting the interleaving paper, and for this reason, this may greatly inhibit a handling property. As a method for adjusting a surface electric resistance value to a desirable range, for example, moisture adjustment due to drying or the like may be mentioned.

EXAMPLES

Hereinafter, the present invention is described in detail with reference to Examples and Comparative Examples. It should be understood that the present invention is not limited to these Examples.

(1) Evaluation of Damage Occurring on the Surface of Glass

One hundred glass substrates for liquid crystal displays having a size of 1500 mm×1800 mm×0.7 mm and 100 sheets of interleaving paper having the same size as described above were alternately laminated. The obtained laminate was vertically held between a pair of acrylic plates, each plate having the same size as described above and a thickness of 1 mm. The laminate held by the acrylic plates was tied by a rubber string to fix them and was provided in a shaking machine to shake the laminate for 24 hours at 300 rpm. Subsequently, the rubber string was untied, and each of the 100 glass plates was subjected to light exposure from the side of the glass plate to confirm whether or not there is damage (scratch and the like) on the front and rear surfaces of the glass plate by means of a microscope.

(2) Examination of Foreign Substances of Glass Plate-Interleaving Paper

With respect to the interleaving paper attached to the glass plate in which damage were observed in the aforementioned "(1) Evaluation of damage occurring on the surface of glass", the foreign substances causing damage on the surface of the glass plate were searched by means of a stereoscopic microscope of 100 magnifications. In addition, the materials of the foreign substances mentioned above were specified by means of an X-ray diffraction microscope. Also, the size of the foreign substance was measured to calculate the volume thereof.

<Manufacture of Wood Pulp>

In an apparatus for manufacturing needle bleached kraft pulp, comprising a cooking process, a washing process, an oxygen delignification reaction process, and a multistage bleaching process with chlorine dioxide and hydrogen peroxide, an apparatus for removing metal in which a plurality of magnet bars of 10000 gauss were arranged was provided on a pulp-transfer line after the multistage bleaching process, to remove metallic foreign substances such as an iron component and the like present in a pulp slurry. As described above, needle bleached kraft pulp A was obtained.

In addition, needle bleached kraft pulp B was obtained in the same manner as described above, with the exception of using none of the inline box in which the aforementioned magnet bars were arranged.

Example 1

As wood pulp, needle bleached kraft pulp A in an amount of 100 parts by mass was prepared, and disaggregated to prepare a slurry having a beating degree of 520 ml c.s.f. Polyacrylamide (product name: Polystron 1250, manufactured by Arakawa Chemical Industries Ltd.) was added as a paper strength agent in an amount of 0.4 parts by mass with respect to the total pulp mass. Thereby, a pulp slurry with a 0.4% concentration was prepared. The obtained pulp slurry was subjected to paper making by means of a Fourdrinier paper machine. Thereby, glass plate-interleaving paper with a base weight of 50 g/m$^2$ was obtained.

Comparative Example 1

Glass plate-interleaving paper having a base weight of 50 g/m$^2$ was obtained in the same manner as that of Example 1, with the exception of using 100 parts by mass of needle bleached kraft pulp B.

Comparative Example 2

Glass plate-interleaving paper having a base weight of 50 g/m$^2$ was obtained in the same manner as that of Example 1, with the exception of using 50 parts by mass of needle bleached kraft pulp A and 50 parts by mass of needle bleached kraft pulp B.

Example 2

Glass plate-interleaving paper having a base weight of 50 g/m$^2$ was obtained in the same manner as that of Example 1, with the exception of using 90 parts by mass of needle bleached kraft pulp A and 10 parts by mass of waste paper pulp.

Example 3

Glass plate-interleaving paper having a base weight of 50 g/m$^2$ was obtained in the same manner as that of Example 1, with the exception of using 80 parts by mass of needle bleached kraft pulp A and 20 parts by mass of needle bleached kraft pulp B.

Comparative Example 3

Glass plate-interleaving paper having a base weight of 50 g/m$^2$ was obtained in the same manner as that of Example 1, with the exception of using 50 parts by mass of needle bleached kraft pulp A and 50 parts by mass of ground pulp.

Comparative Example 4

Glass plate-interleaving paper having a base weight of 50 g/m$^2$ was obtained in the same manner as that of Example 1, with the exception of using 30 parts by mass of needle bleached kraft pulp A and 70 parts by mass of waste paper pulp.

The foreign substances of glass plate-interleaving paper obtained in the Examples and Comparative Examples are shown in Table 1.

TABLE 1

| | Number of foreign substances having a Mohs hardness of 4 or more (number of foreign substances/m$^2$) | Type of foreign substances having a Mohs hardness of 4 or more | Mohs hardness of foreign substances | Volume of foreign substances (mm$^3$) |
|---|---|---|---|---|
| Example 1 | 0 | None | None | None |
| Example 2 | 0.004 | Magnesium oxide | 4 | 0.000018 |
| Example 3 | 0.008 | Iron oxide | 6 | 0.000024 |
| Comparative Example 1 | 0.011 | Iron oxide | 6 | 0.000024 |
| Comparative Example 2 | 0.019 | Magnesium oxide | 4 | 0.000032 |
| Comparative Example 3 | 0.070 | Iron oxide | 6 | 0.000034 |
| | | Quartz | 7 | 0.000066 |
| Comparative Example 4 | 0.063 | Titanium oxide | 6 | 0.000052 |
| | | Magnesium oxide | 4 | 0.000038 |

As a result of transportation tests of glass plate-interleaving paper obtained in the Examples and Comparative Examples, any damage or cracks were not observed at all on the surface of the glass plates using the glass plate-interleaving paper according to Example 1 and Example 2. In Example 3, micro-damage was slightly observed. At the time of array formation of a liquid crystal panel using the glass plate used in each of Examples 1 to 3, disconnection of color film was not observed in all cases. On the other hand, on the surface of the glass plate using the glass plate-interleaving paper according to each of Comparative Examples 1 to 4, micro-damage was observed in all cases. At the time of array formation of a liquid crystal panel using the glass plate used in each of Comparative Examples 1 to 4, disconnection of floor film was observed in all cases.

From the results shown above, in the glass plate-interleaving paper of the present invention, the number of foreign substances having a Mohs hardness of 4 or more is less than 0.010 per 1 m$^2$, and for this reason, even if the interleaving paper mentioned above is used for a glass plate, functions as interleaving paper can be suitably exhibited without occurrences of damage or cracks which are problems on the surface of the glass plate. As a result, a glass plate on which array formation of a liquid panel can be suitably carried out can be produced.

What is claimed is:

1. A glass plate-interleaving paper, of which a raw material is wood pulp, wherein the number of foreign substances having a Mohs hardness of 4 or higher present on a surface of said glass plate-interleaving paper is 0.004 per square meter or more and fewer than 0.010 per square meter.

2. The glass plate-interleaving paper according to claim 1, wherein said foreign substances comprise metal oxide or inorganic silicon oxide.

3. The glass plate-interleaving paper according to claim 2, wherein said inorganic silicon oxide is silicon dioxide.

4. The glass plate-interleaving paper according to claim 1, wherein said foreign substances are one or more substances selected from the group consisting of iron oxide, copper, quartz, fused quartz, glass pieces, crystal pieces, magnesium oxide, titanium oxide, and sand.

5. The glass plate-interleaving paper according to claim 1, wherein said foreign substances have a volume of less than $2\times10^{-5}$ $mm^3$.

6. The glass plate-interleaving paper according to claim 1, wherein said glass plate-interleaving paper has a basis weight ranging from 20 to 100 $g/m^2$.

7. The glass plate-interleaving paper according to claim 1, wherein said glass plate-interleaving paper has a thickness ranging from 0.030 to 0.130 mm.

8. The glass plate-interleaving paper according to claim 1, wherein said glass plate-interleaving paper has a moisture content ranging from 2 to 10% by mass.

9. The glass plate-interleaving paper according to claim 1, for a glass plate for use in a display.

10. The glass plate-interleaving paper according to claim 9, wherein said display is a thin film transistor (TFT) liquid crystal display or an organic electroluminescence (EL) display.

11. A laminate comprising glass plates and the glass plate-interleaving paper as recited in claim 1.

* * * * *